United States Patent [19]

Short, Sr.

[11] Patent Number: 4,509,105

[45] Date of Patent: Apr. 2, 1985

[54] LAMP ASSEMBLY

[76] Inventor: Henry A. Short, Sr., 556 E. 88th St., Chicago, Ill. 60619

[21] Appl. No.: 586,307

[22] Filed: Mar. 5, 1984

[51] Int. Cl.[3] ..... F21P 1/02

[52] U.S. Cl. ..... 362/122; 362/125; 362/253; 362/414; 362/806; 362/808

[58] Field of Search ..... 362/122, 125, 253, 414, 362/806, 808

[56] References Cited

U.S. PATENT DOCUMENTS

| | | | |
|---|---|---|---|
| 1,788,058 | 1/1931 | Jyumi | 362/122 X |
| 2,141,769 | 12/1938 | Simpson | 362/122 X |
| 4,028,848 | 6/1977 | Murray | 362/412 X |

*Primary Examiner*—Stephen J. Lechert, Jr.
*Attorney, Agent, or Firm*—Thomas R. Vigil

[57] ABSTRACT

The lamp assembly includes a modular base portion and a lamp socket and shade supporting assembly mounted on the base portion. The base portion comprises first, second and third substantially identical-in-shape shells. Each shell has an annular flange at one end and an end wall at the other end. The shells are stacked with the annular flange of the first shell positioned on the bottom of the stack. Two end walls of the first and second shells abut each other and the end walls are secured together. Two annular flanges of the second and third shells abut each other and the end wall of the third shell mounts the lamp socket and shade supporting assembly. A platform is positioned between the annular flanges of the second and third shells. A display item is placed on the platform with the third shell being transparent. Finally, a band is releasably clamped across the area of the second and third shells where the flanges thereof abut each other.

9 Claims, 3 Drawing Figures

LAMP ASSEMBLY

BACKGROUND OF THE INVENTION

1. Field of the Invention

The present invention relates to a lamp assembly and more particularly to a modular base portion of the lamp assembly including a display platform.

2. Description of the Prior Art

Heretofore, a number of lamp assemblies have been proposed having unique base portions that are separable and apart so as to be modular and which include special display features for displaying various items. Examples of these previously proposed lamp assemblies are disclosed in the following U.S. patents:

| U.S. PAT. NO. | PATENTEE |
|---|---|
| 272,567 | Marsh |
| 1,762,634 | Jyumi |
| 1,944,040 | Tam |
| 2,125,358 | Renholdt |
| 2,945,948 | Maffei |
| 4,028,848 | Murray |

The Marsh U.S. Pat. No. 272,567 discloses a lamp having modular nonidentical base portion components for constructing at least two different lamp base portion assemblies. The base portion assembly includes a vase-type portion mounted on a base and an upper portion which can be a cup-shaped piece. No provision is provided for displaying a display item within the vase-shaped portion.

The Jyumi U.S. Pat. No. 1,762,634 discloses a fish bowl and lamp combination where the base portion of the lamp includes a fish bowl with water and fish therein.

The Tam U.S. Pat. No. 1,944,040 discloses a lamp holder and fastener which is adapated for mounting on top of a fish bowl.

The Renholdt U.S. Pat. No. 2,125,358 discloses a lamp comprising a lower part including a semi-spherical hollow shell and an upper part or dome which is made of a transparent material such as clear or tinted glass. Within the dome and supported by the rim of the lower part, or shell, is a platform having an ornament mounted thereon such as a model sailboat. The base portion assembly further includes a pedestal on which the hollow shell lower part is mounted. An electrical cord extends from a lamp socket mounted on top of the dome. A metal ring or ferrule extends about the lamp base portion engaging and holding an upper flange of the lower hollow part to a lower flange of the dome.

In the Renholdt patent the lamp base portion assembly includes nonidentical, nonsymmetrical shell components. Further, the lamp cord does not extend up through the base portion to the lamp socket so as to provide a more aesthetic pleasing lamp.

The Maffei U.S. Pat. No. 2,945,948 discloses a lamp assembly comprising a base having a cup formation mounted thereon and supporting a sphere with another cup shaped portion resting on top of the sphere and mounting thereon a lamp socket assembly.

In the Maffei assembly, a lamp cord extends through the pedestal and up through a hollow tube within the base portion of the lamp assembly.

The Murray U.S. Pat. No. 4,028,848 discloses a lamp pedestal with terrarium bowl and includes a lower base portion which includes as a part thereof a terrarium lower bowl of transparent material, either glass or plastic. The bowl is integral with the base. Supported above the bowl is an upper bowl of transparent material which is shaped to form a pear with the lower bowl. A tube extension extends from the base through both bowls to a cap on which a lamp socket and shade supporting assembly is mounted. The bowl portions of the base portion assembly of this lamp are not identical and no platform is provided for supporting display items.

As will be described in greater detail hereinafter, the lamp assembly of the present invention and more particularly, the base portion thereof, differs from the previously proposed lamp assemblies by providing a modular base portion comprised of three substantially identical shells, one of which is made of a clear transparent material and which forms an upper shell of the modular base portion assembly. A platform is releasably fixed between this shell and the next lower adjacent shell and is adapted to support a display item thereon.

The two upper shells of the lamp base portion assembly can be separated for gaining access to the display item on the platform for changing same. One preferred display item is a nativity scene.

It is noted that a number of design patents have been issued on lamp assemblies that have a religious motif such as including the shape of a cross as part of the lamp assembly. Examples of these previously proposed lamp assemblies having a religious motif are disclosed in the following patents:

| U.S. PAT. NO. | PATENTEE |
|---|---|
| Des. 178,465 | Naimon |
| Des. 179,033 | Rider |
| Des. 204,411 | Shirley |
| Des. 213,463 | Davis |

None of these design patents disclose a nativity scene incorporated into a lamp.

SUMMARY OF THE INVENTION

According to the present invention, there is provided a lamp assembly comprising a modular base portion, a lamp socket and shade supporting assembly mounted on said base portion and said base portion comprising first, second and third substantially identical-in-shape shells each having an annular flange at one end and an end wall at the other end, said shells being stacked with the annular flange of said first shell positioned on the bottom of said stack, two end walls of said first and second shells abutting each other, each end having an opening therethrough, means for securing said end walls together, two annular flanges of said second and third shells abutting each other and said end wall of said third shell mounting said lamp socket and shade supporting assembly, a platform positioned between said annular flanges of said second and third shells and having a central opening therein, a hollow tube extending within said second and third shells between said end walls thereof, a lamp cord which extends through said end wall openings from said first shell to said lamp socket assembly, a display item on said platform, said third shell being transparent, and means for releasably clamping said second and third shells together.

DESCRIPTION OF THE PREFERRED EMBODIMENT

Figure 1:
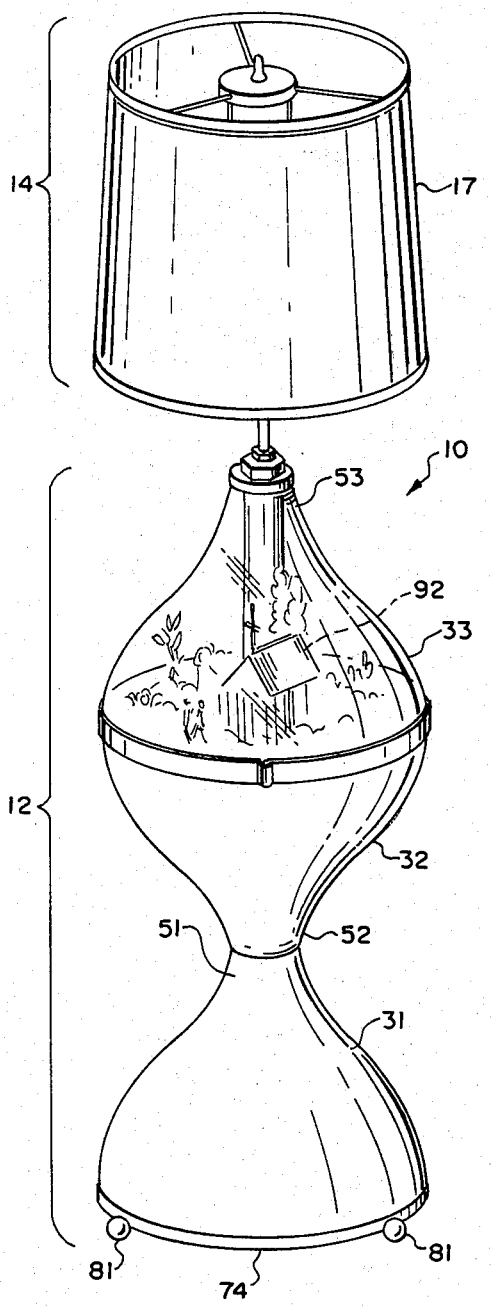
FIG. 1 is a perspective view of a modular lamp assembly constructed according to the teachings of the present invention.

Referring now to FIG. 1, a modular lamp assembly 10 constructed according to the teachings of the present invention is shown therein. The lamp assembly 10 includes a novel base portion 12 from which extends a conventional lamp mounting and shade supporting assembly 14 (FIG. 2) mounting electric lamp 16 (FIG. 2) and shade 17. The assembly 14 includes a lamp socket 18 and a framework 20 extending about and above the lamp 16 and having a threaded stud 22 on which the shade is received and fixed in place by a nut 24.

The base portion 12 includes three substantially identical-in-shape body shells 31–33, which can be referred to as a bottom shell 31, a middle shell 32 and a top shell 33. Each shell 31–33 has a semi-spherical shape with a larger-in-diameter annular flange 41,42 or 43 at one end and a tapered neck 51,52 or 53 at the other end thereof, with each neck 51–53 having an end wall 61,62 or 63 with a central throughbore 71,72 or 73 therethrough. Typically, each shell is made of a rigid plastic material.

The bottom shell 31 is preferably painted or made of a solid colored plastic, e.g. white. The middle shell 32 is usually colored the same color as the shell 31 and the shell 33 is made of a clear/transparent plastic material.

Figure 2:
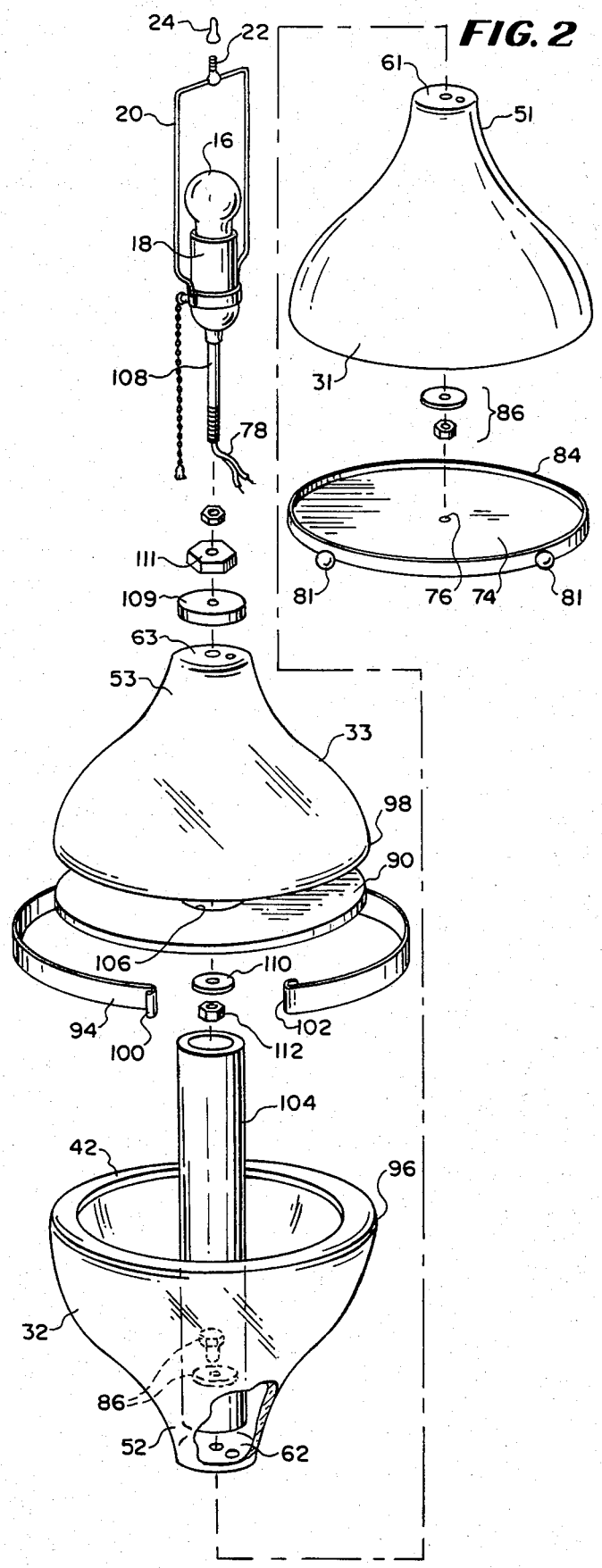
FIG. 2 is an exploded perspective view of the lamp assembly shown shown in FIG. 1 excluding the lamp shade.
Figure 3:
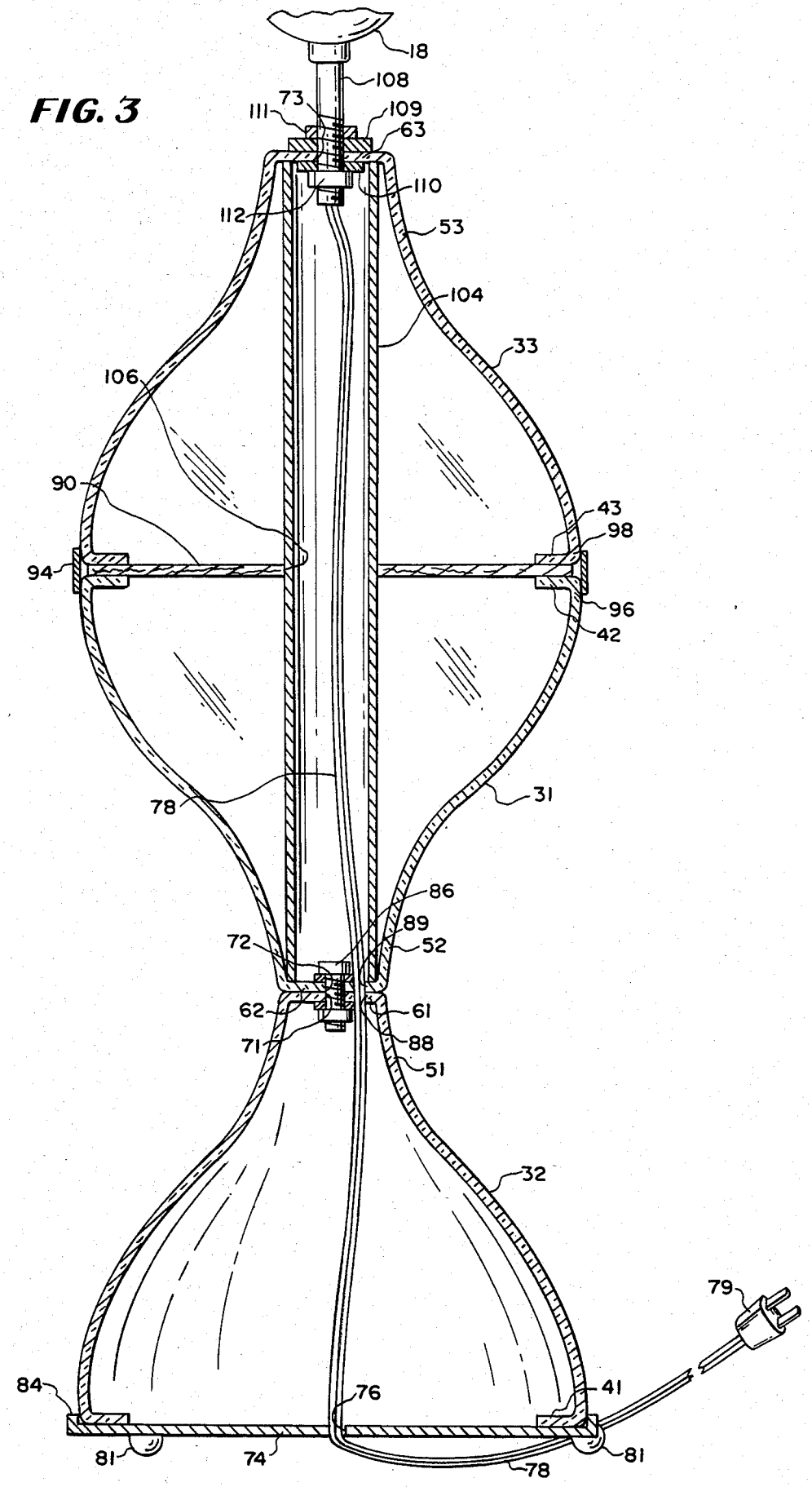
FIG. 3 is a vertical sectional view through the lamp assembly shown in FIG. 1 up to the electric lamp thereof.

As shown in FIGS. 1–3, the bottom shell is positioned with the annular flange 41 facing downwardly against a base plate 74 which has a small central opening 76 through which a lamp cord 78 having a plug 79 at the end thereof extends. Also, three leg forming knobs are secured at spaced apart locations to the base plate 74, as shown, to provide a space beneath the base plate 74 for the lamp cord 78 and for supporting the lamp assembly 10 on a planar surface.

The base plate 74 has an upstanding rim 84 which surrounds the bottom shell 31. The shell 31 can be press-fitted onto the base plate 74, secured thereto by an adhesive or solvent bonding, or bolted thereto by bolts and nuts, not shown.

The end wall 61 abuts the end wall 62 of the shell 32 and is secured thereto by a nut and bolt assembly 86. The end walls 61,62 have additional bores 88,89 therethrough with the bores 88 and 89 aligned with each other to form a bore through which the lamp cord 78 extends.

The annular flange 42 of the upper end of the shell 32 supports a platform 90 which is positioned between flange 42 of shell 32 and flange 43 of shell 33. According to the teachings of the present invention, the platform 90 is releasably coupled between the flanges 42 and 43 whereby any type of desired display item 92 can be positioned on, and preferably releasably fixed to the platform 90, and whereby the display item 92, which is a nativity scene in FIG. 1, can be changed to another display item, e.g., from a nativity scene to a garden scene.

The display items 92 can take any desired form, e.g. a sailboat, a sports car, a rock garden, etc. and can be easily changed, if desired.

The flanges 42 and 43 are held in place by a band 94 which extends around the juxtaposed outer edges 96 and 98 of shells 32 and 33 and which has mating, hook-like, latch end formations 100 and 102 which are hooked together to clamp the shells 32 and 33 in place.

To rigidify the assembly of the two shells 32 and 33, a hollow tube 104 is provided which extends within the shells 32 and 33 between end walls 62 and 63 through a center hole 106 in the platform 90.

The top of the lamp base portion 12, comprised of the three modular shells 31–33, has mounted at and to the upper end wall 63 of shells 33, the lamp mounting and shade supporting assembly 14. As shown in FIG. 2, the bottom of the lamp socket 18 has a threaded tube 108 depending therefrom. This tube 108 extends through the throughbore 73 and is fixed on end wall 63 between washers 109,110 by nuts 111 and 112 threadably received on the tube 108. The lamp cord 78 extends through tube 104 and tube 108 to the lamp socket 18 for connection to the lamp socket terminals therein.

Again, the modular shells 31–33 provide a unique and alternative base portion 12 for the lamp 10 which, at the same time, provides a simple clamping band 94 that allows the item 92 to be displayed through and within shell 42 and to be changed as desired. This is simply accomplished by unhooking latch end formations 100 and 102 to release the band 94. The shell 33 and assembly 14 mounted thereon are then lifted to gain access to the top of the platform 90 for changing the display item 92.

From the foregoing description it will be apparent that the lamp assembly 10 of the present invention has a number of advantages, some of which have been described above and others of which are inherent in the lamp assembly 10 of the present invention. Also, modifications can be made to the lamp assembly 10 without departing from the teachings of the invention. Accordingly, the scope of the invention is only to be limited as necessitated by the accompanying claims.

I claim:

1. A lamp assembly comprising a modular base portion, a lamp socket and shade supporting assembly mounted on said base portion and said base portion comprising first, second and third substantially identical-in-shape shells each having an annular flange at one end and an end wall at the other end, said shells being stacked with the annular flange of said first shell positioned on the bottom of said stack, two end walls of said first and second shells abutting each other, each end having an opening therethrough, means for securing said end walls together, two annular flanges of said second and third shells abutting each other and said end wall of said third shell mounting said lamp socket and shade supporting assembly, a platform positioned between said annular flanges of said second and third shells and having a central opening therein, a hollow tube extending within said second and third shells between said end walls thereof, a lamp cord which extends through said end wall openings from said first shell to said lamp socket assembly, a display item on said platform, said third shell being transparent, and means for releasably clamping said second and third shells together.

2. The lamp assembly of claim 1 wherein said display item is a nativity scene.

3. The lamp assembly of claim 1 wherein said display item is a sailboat.

4. The lamp assembly of claim 1 wherein said display item is a model automobile.

5. The lamp assembly of claim 1 wherein said display item is a simulated garden.

6. The lamp assembly of claim 1 including a base plate secured to said annular flange of said first shell.

7. The lamp assembly of claim 6 wherein said base plate has a hole therein for receiving said lamp cord.

8. The lamp assembly of claim 6 including at least three legs secured to said base plate.

9. The lamp assembly of claim 1 wherein said shells are made of plastic.

* * * * *